US009482984B2

(12) United States Patent
Kondo

(10) Patent No.: US 9,482,984 B2
(45) Date of Patent: Nov. 1, 2016

(54) IMAGE FORMING APPARATUS FOR SUPPLYING AND/OR CONTROLLING CORRECTION CURRENT(S) TO A LASER

(71) Applicant: CANON KABUSHIKI KAISHA, Tokyo (JP)

(72) Inventor: Shunsaku Kondo, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/062,622

(22) Filed: Oct. 24, 2013

(65) Prior Publication Data

US 2014/0118456 A1 May 1, 2014

(30) Foreign Application Priority Data

Oct. 29, 2012 (JP) ..... 2012-237798
Sep. 5, 2013 (JP) ..... 2013-184048

(51) Int. Cl.
*G03G 15/043* (2006.01)
*G03G 15/04* (2006.01)

(52) U.S. Cl.
CPC ..... *G03G 15/043* (2013.01); *G03G 15/04072* (2013.01)

(58) Field of Classification Search
CPC ..... G03G 15/043
USPC ..... 347/128, 132, 133, 135, 143–145, 236, 347/237, 246, 247
See application file for complete search history.

(56) References Cited

U.S. PATENT DOCUMENTS

| | | | | |
|---|---|---|---|---|
| 4,835,780 | A * | 5/1989 | Sugimura et al. | 372/29.01 |
| 5,761,231 | A * | 6/1998 | Ofenloch et al. | 372/38.04 |
| 7,170,536 | B2 * | 1/2007 | Inagawa et al. | 347/133 |
| 7,701,480 | B2 * | 4/2010 | Omori et al. | 347/237 |
| 2011/0221847 | A1 * | 9/2011 | Takezawa | 347/118 |
| 2011/0241571 | A1 * | 10/2011 | Maeda et al. | 315/307 |

FOREIGN PATENT DOCUMENTS

| | | | | |
|---|---|---|---|---|
| JP | S63-213983 | A | 9/1988 | |
| JP | 5-328071 | A | 12/1993 | |
| JP | 2006-091553 | A | 4/2006 | |
| JP | 2008-027977 | A | 2/2008 | |
| JP | 2012-155134 | A | 8/2012 | |
| JP | 2012150338 | A * | 8/2012 | G03G 15/04 |

* cited by examiner

*Primary Examiner* — Shelby Fidler
(74) *Attorney, Agent, or Firm* — Canon USA, Inc. I.P. Division

(57) ABSTRACT

An image forming apparatus is provided for controlling current(s) supplied to a semiconductor laser. In one or more embodiments, an image forming apparatus corrects a value of the driving current and a value of at least one correction current (e.g., first and/or second correction current(s)) supplied in synchronization with the supply start of the driving current based on a reception result of a light receiving unit. In one or more embodiments, an image forming apparatus includes a correction current supply unit including a first correction current generation unit for generating a first correction current that attenuates over time and a second correction current generation unit for generating a second correction current that attenuates over time and of which an attenuation speed is lower than that of the first correction current, and configured to supply the first correction current and the second correction current to the semiconductor laser.

7 Claims, 9 Drawing Sheets

IMAGE FORMING APPARATUS FOR SUPPLYING AND/OR CONTROLLING CORRECTION CURRENT(S) TO A LASER

BACKGROUND

Field

Aspects of the present invention generally relate to a technique for controlling a current supplied to a semiconductor laser provided in an image forming apparatus.

Description of the Related Art

An electrophotographic image forming apparatus forms an electrostatic latent image on a photosensitive member by exposing the photosensitive member to a laser beam output from a semiconductor laser. The electrostatic latent image formed on the photosensitive member is developed with a toner, and the developed toner image is transferred onto a recording medium. Then, the toner image transferred on the recording medium is fixed, and thus an image is formed on the recording medium.

The semiconductor laser emits a laser beam by receiving a driving current. The semiconductor laser has been known to have light emission delay characteristics. As illustrated in FIG. 8, the driving current ((b) in FIG. 8) is supplied to the semiconductor laser based on an image signal ((a) in FIG. 8). The light emission delay is a characteristic in which the rising of a light amount wave form of the laser beam lags a supply start timing of the driving current as illustrated in (c) in FIG. 8. Thus, there is a time lag between the supply of the driving current to the semiconductor laser and the output of the laser beam of a target light amount. Accordingly, with the electrophotographic image forming apparatus using the semiconductor laser as a light source for exposing the photosensitive member to light, the amount of light to which the photosensitive member is exposed might be insufficient due to the light emission delay characteristics of the semiconductor laser. As a result, an image with a density lower than a desired level might be output.

In view of such a problem, Japanese Patent Application Laid-Open No. 5-328071 discusses a method for preventing the output of an image with a low density due to an insufficient light amount at the time of the rising of the light amount. Specifically, a correction current that attenuates at a predetermined time constant from a peak value is generated by a differential circuit and, at the supply start timing of a driving current to a semiconductor laser, the correction current is superimposed on the driving current.

However, in an image forming apparatus in which the peak value of a correction current is set to a fixed value as discussed in Japanese Patent Application Laid-Open No. 5-328071, the light amount cannot be sufficiently corrected when the light amount of the laser beam to which the photosensitive member is exposed is adjusted based on the state of the image forming apparatus. For example, the following case is considered. Specifically, when the light amount of the laser beam to which the photosensitive member is exposed is adjusted to a first light amount, a driving current supplied to a semiconductor laser is adjusted to a first current value. Furthermore, when the light amount is adjusted to a second light amount smaller than the first light amount, a driving current supplied to the semiconductor laser is adjusted to a second current value smaller than the first current value. Here, the rate of the peak value of the correction current with respect to the first current value is different from the rate of the peak value of the correction current with respect to the second current value. Thus, when the peak value of the correction current is set with one of the first and the second current values used as a reference value, the rising of the light amount is not sufficiently corrected if the value of the driving current supplied to the semiconductor laser is set to the current value that is not used as the reference value.

SUMMARY

According to an aspect of the present invention, an image forming apparatus includes a semiconductor laser configured to emit a laser beam by receiving a driving current, a photosensitive member configured to be exposed to the laser beam emitted from the semiconductor laser so that an electrostatic latent image is formed thereon, a driving current supply unit configured to supply the driving current to the semiconductor laser based on an image signal, a correction current supply unit configured to supply a correction current that attenuates over time to the semiconductor laser, and a light receiving unit configured to receive the laser beam emitted from the semiconductor laser, wherein the driving current supply unit supplies the driving current of a value based on a reception result of the light receiving unit to the semiconductor laser, and the correction current supply unit supplies the correction current that attenuates over time from a peak value based on the reception result of the light receiving unit to the semiconductor laser.

Further features of the present disclosure will become apparent from the following description of exemplary embodiments with reference to the attached drawings.

DESCRIPTION OF THE EMBODIMENTS

Figure 1:
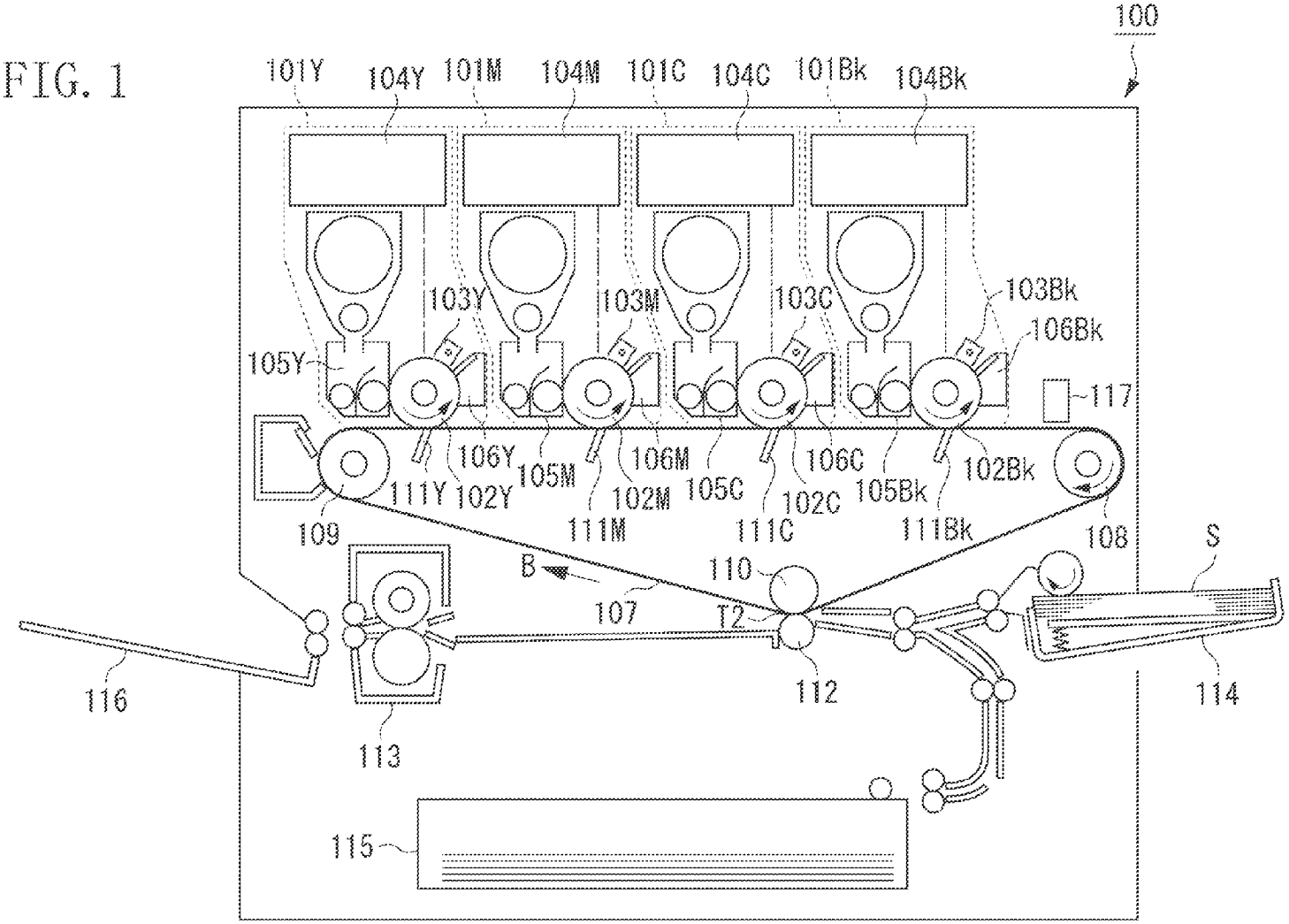
FIG. 1 is a schematic cross-sectional view of a color image forming apparatus.

FIG. 1 is a schematic cross-sectional view of a digital full color printer (color image forming apparatus) that forms an image with a plurality of color toners. Although an exemplary embodiment is described with the color image forming apparatus as an example, the exemplary embodiment is not limited to the color image forming apparatus and may be an image forming apparatus that forms an image with a single color toner (e.g., black).

First, an image forming apparatus 100 of the present exemplary embodiment is described with reference to FIG.

1. The image forming apparatus 100 includes four image forming units 101Y, 101M, 101C, and 101Bk that respectively form toner images (images) of different colors. The reference signs Y, M, C, and Bk respectively represent yellow, magenta, cyan, and black. The image forming units 101Y, 101M, 101C, and 101Bk respectively use yellow, magenta, cyan, and black toners to form toner images.

The image forming units 101Y, 101M, 101C, and 101Bk respectively include photosensitive drums 102Y, 102M, 102C, and 102Bk as photosensitive members. Furthermore, the image forming units 101Y, 101M, 101C, and 101Bk respectively include charging devices 103Y, 103M, 103C, and 103Bk, optical scanning devices 104Y, 104M, 104C, and 104Bk, and developing devices 105Y, 105M, 105C, and 105Bk. The image forming units 101Y, 101M, 101C, and 101Bk are respectively provided with cleaning devices 106Y, 106M, 106C, and 106Bk.

The image forming apparatus 100 of the present exemplary embodiment includes an intermediate transfer belt 107 (intermediate transfer member) having an endless belt shape. The intermediate transfer belt 107 is disposed below the photosensitive drums 102Y, 102M, 102C, and 102Bk. The intermediate transfer belt 107 is stretched around a drive roller 108 and driven rollers 109 and 110 and rotates in a direction indicated by an arrow B in FIG. 1 during the image forming. The photosensitive drums 102Y, 102M, 102C, and 102Bk are positioned to respectively face primary transfer devices 111Y, 111M, 111C, and 111Bk with the intermediate transfer belt 107 disposed in between.

The image forming apparatus 100 of the present exemplary embodiment further includes a secondary transfer device 112 that transfers a toner image on the intermediate transfer belt 107 onto a recording medium S, and a fixing device 113 that fixes the toner image on the recording medium S.

Now, the image forming process from a charging step to a developing step of the image forming apparatus 100 having such a configuration is described. The image forming process is the same as one another in the image forming units. Thus, the image forming process is described by using the image forming unit 101Y as an example, and the image forming processes in the image forming units 101M, 101C, and 101Bk will not be described.

The rotationally driven photosensitive drum 102Y is charged by the charging device 103Y of the image forming unit 101Y. The charged photosensitive drum 102Y (image bearing member) is exposed to a laser beam emitted from the optical scanning device 104Y. Thus, an electrostatic latent image is formed on the rotating photosensitive drum 102Y. Then, the electrostatic latent image formed on the photosensitive drum 102Y is developed as a yellow toner image by the developing device 105Y.

The image forming process at and after the transfer step is described by using the image forming unit as an example. When the primary transfer devices 111Y, 111M, 111C, and 111Bk apply transfer bias to the intermediate transfer belt 107, the yellow, magenta, cyan, and black toner images respectively formed on the photosensitive drums 102Y, 102M, 102C, and 102Bk of the image forming units are transferred onto the intermediate transfer belt 107. Thus, the color toner images of are superimposed one on top of the other on the intermediate transfer belt 107.

The four color toner image formed on the intermediate transfer belt 107 is conveyed to a secondary transfer portion T2 formed by the driven roller 110 and the secondary transfer device 112. At the secondary transfer portion, the four color toner image on the intermediate transfer belt 107 is transferred onto the recording medium S conveyed to the secondary transfer portion T2 from a manual sheet feeding cassette 114 or a sheet feeding cassette 115. The toner image transferred on the recording medium S is heated and fixed by the fixing device 113. After passing through the fixing device 113, the recording medium S is discharged to a sheet discharge unit 116. An optical sensor 117 irradiates a density detection toner image (toner pattern) formed by the image forming units and transferred on the intermediate transfer belt 107 with light and detects the reflected light. The optical sensor 117 inputs the detection result to a CPU 211.

The toner not transferred onto the intermediate transfer belt 107 and thus remaining on the photosensitive drums 102Y, 102M, 102C, and 102Bk is removed from the photosensitive drums by the cleaning devices 106Y, 106M, 106C, and 106Bk.

The configuration of the optical scanning devices 104Y, 104M, 104C, and 104Bk as exposure units is described with reference to FIGS. 2 and 3. The optical scanning apparatuses have the same configuration, and thus the letters Y, M, C, and Bk representing the colors are omitted in the following description.

Figure 2:
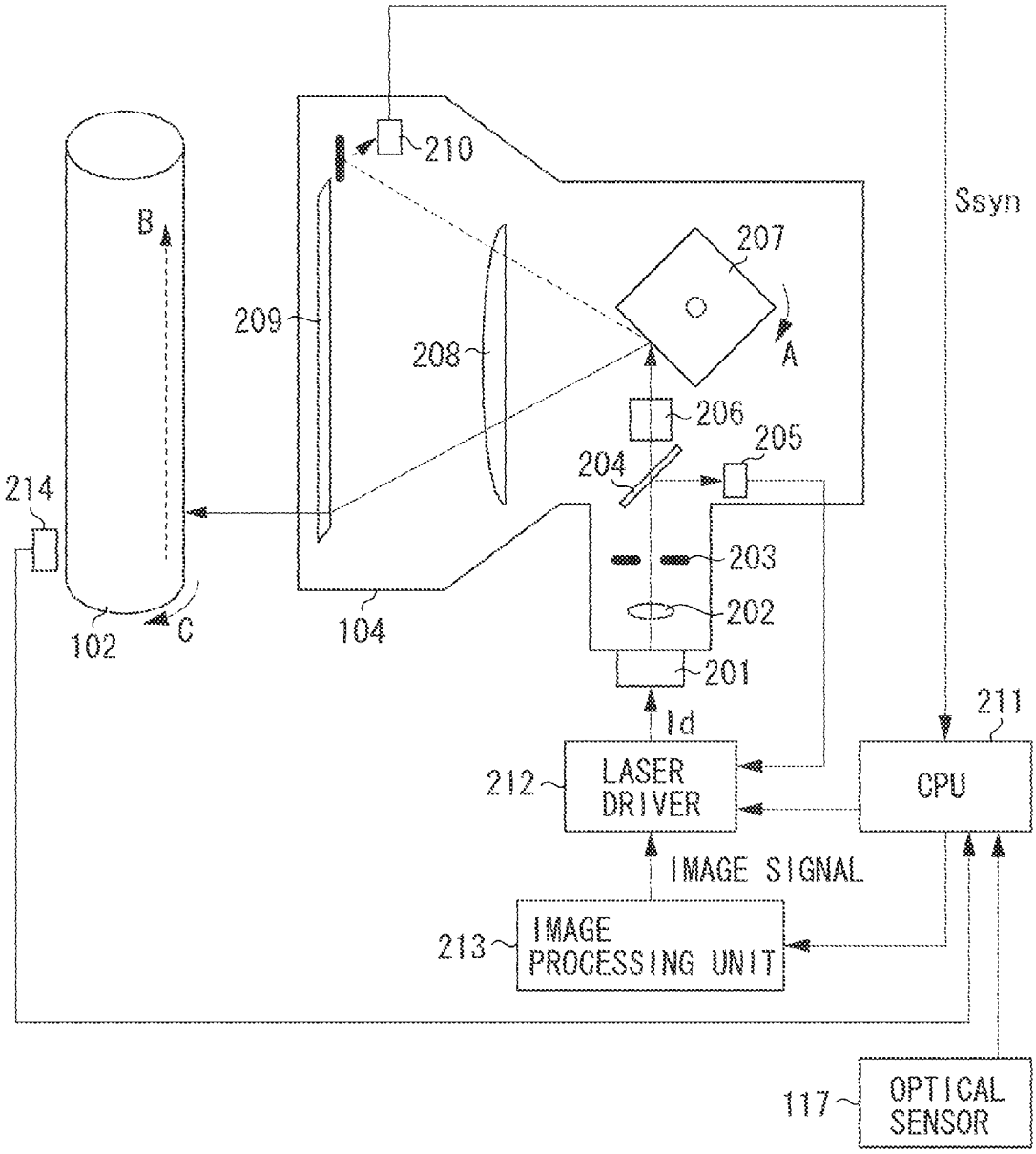
FIG. 2 is a schematic configuration diagram of an optical scanning device.

FIG. 2 is a schematic diagram illustrating the optical scanning device 104 and the photosensitive drum 102 illustrated in FIG. 1. The optical scanning device 104 includes a semiconductor laser 201, a collimator lens 202, a diaphragm 203, a beam splitter 204, a photodiode 205, and a cylindrical lens 206. The optical scanning device 104 further includes a rotary multifaceted mirror 207, an fθ lens 208, a reflection mirror 209, and a beam detector 210 (hereinafter, referred to as BD 210).

The semiconductor laser 201 (laser beam source) emits a laser beam (light beam). The optical scanning device of the present exemplary embodiment includes a Vertical Cavity Surface Emitting LASER (VCSEL) as the semiconductor laser 201. Alternatively, an edge emitting semiconductor laser may be employed.

The semiconductor laser 201 is driven by a laser driver 212 (laser control device). The laser driver 212 is connected to the CPU 211 and an image processing unit 213. In response to input of an image formation job to the image forming apparatus 100 from an external information terminal such as a reading apparatus or a personal computer (PC) (not illustrated), the CPU 211 outputs a light emission enable signal to the laser driver 212.

The image processing unit 213 processes image data included in the image formation job input to the image forming apparatus 100 from the external information terminal such as a reading apparatus or a PC, and then outputs the processed image data as an image signal to the laser driver 212. The laser driver 212 supplies a driving current Id to the semiconductor laser 201 based on the input signal (driving signal) output from the image processing unit 213. By receiving the driving current Id from the laser driver 212, the semiconductor laser 201 emits a laser beam.

The collimator lens 202 collimates the laser beam emitted from the semiconductor laser 201 into substantially parallel rays. The diaphragm 203 forms a spot shape of the laser beam that has passed through the collimator lens 202. The laser beam that has passed through the diaphragm 203 is incident on the beam splitter 204 as a beam splitting unit. The laser beam incident on the beam splitter 204 is split into a first laser beam (reflected laser beam) reflected by the beam splitter 204 and a second laser beam (transmitted laser beam) that transmits through the beam splitter 204.

The first laser beam is incident on the photodiode 205 as a light receiving unit, whereas the second laser beam transmits through the cylindrical lens 206 to be incident on a reflection surface of the rotary multifaceted mirror 207 (polygon mirror) as a deflection unit.

The rotary multifaceted mirror 207 is rotationally driven in a direction indicated by an arrow A by a motor not illustrated. The laser beam that has transmitted through the cylindrical lens 206 is deflected by the reflection surface of the rotary multifaceted mirror 207 rotationally driven, in such a manner that the photosensitive drum 102 illustrated in FIG. 2 is scanned in a direction indicated by the arrow B. The second laser beam deflected by the rotary multifaceted mirror 207 transmits through the fθ lens 208 and is reflected by the reflection mirror 209 to be guided onto the photosensitive drum 102.

The second laser beam deflected by the rotary multifaceted mirror 207 is incident on the BD 210. Upon receiving the second laser beam, the BD 210 generates a synchronization signal Ssyn to be sent to the CPU 211 illustrated in FIG. 2. The CPU 211 controls execution timings of various controls based on the synchronization signal Ssyn.

Upon receiving the driving signal Id from the laser driver 212 based on the image signal, the semiconductor laser 201 emits a laser beam. A potential sensor 214 is disposed around the photosensitive drum 102. The potential sensor 214 is disposed between the radiation position of the laser beam and the developing device 105 and faces the surface of the photosensitive drum 102 to be capable of detecting the surface potential of the photosensitive drum 102. The potential sensor 214 detects the surface potential of the photosensitive drum 102, and the detection result thereof is input to the CPU 211. The CPU 211 outputs a gain adjustment signal to the laser driver 212 based on the detection result of the potential sensor 214 and/or the optical sensor 117. The gain adjustment signal corresponds to the state of the image forming apparatus 100.

Figure 3:
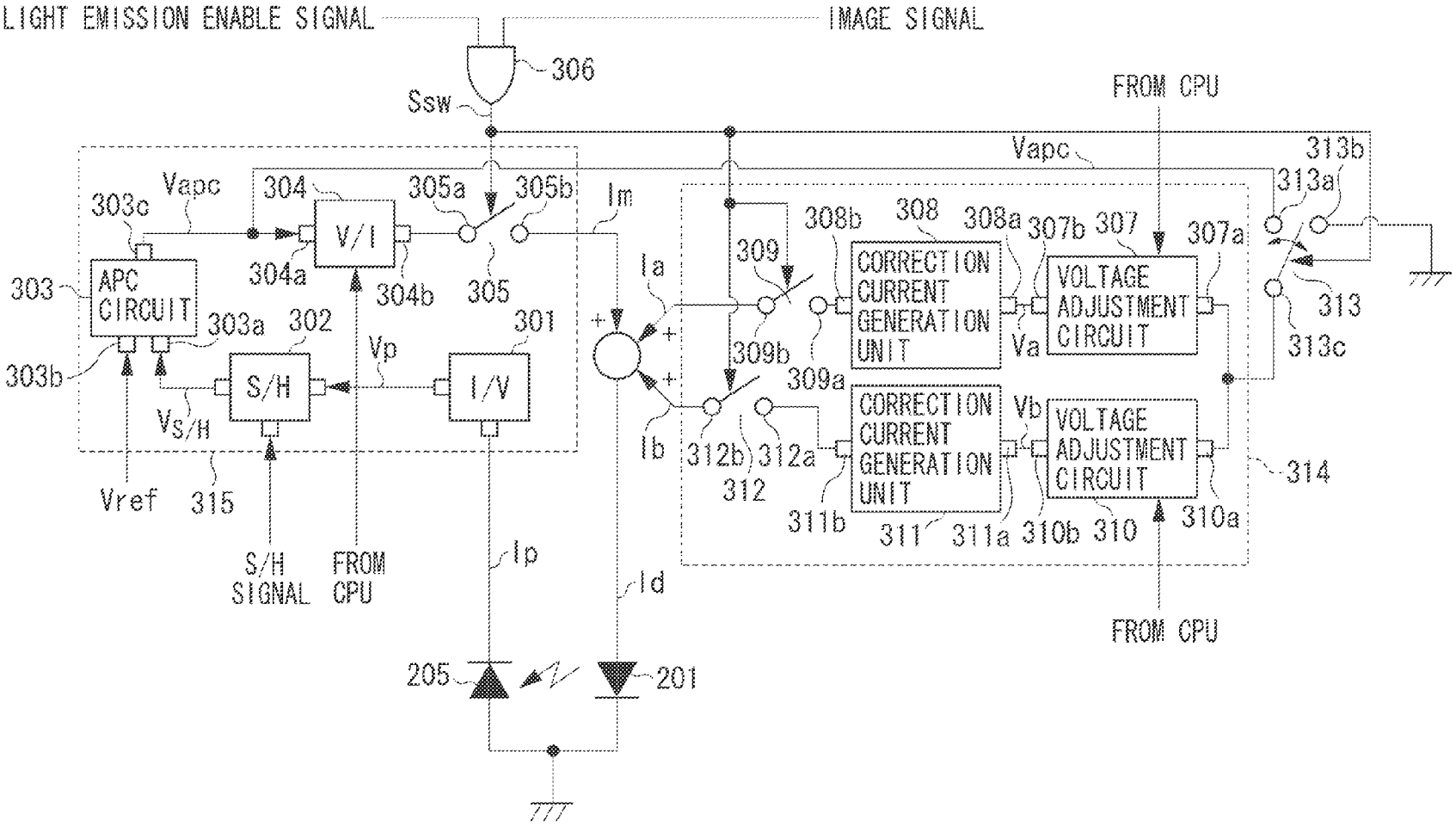
FIG. 3 is a schematic configuration diagram of a laser driver.

The laser driver 212 is described further in detail with reference to FIG. 3. The laser driver 212 includes a current/voltage conversion circuit 301 (I/V conversion circuit 301), a sample and hold circuit 302 (S/H circuit 302), and an auto power control (APC) circuit 303 (voltage setting unit). Furthermore, the laser driver 212 includes a voltage/current conversion circuit 304 (V/I conversion circuit 304), a switch 305 (first switch), and an AND circuit 306. Still furthermore, the laser driver 212 includes a voltage adjustment circuit 307 (charging unit), a correction current generation unit 308, a switch 309 (second switch), a voltage adjustment circuit 310 (charging unit), a correction current generation unit 311, a switch 312 (third switch), and a switch 313 (fourth switch).

The I/V conversion circuit 301, the S/H circuit 302, the APC circuit 303, the V/I conversion circuit 304, and the switch 305 form a driving current supply unit 315. The driving voltage supply unit 315 supplies a main voltage Im (first current) as a driving current to the semiconductor laser 201. The voltage adjustment circuit 307, the correction current generation unit 308, the switch 309, the voltage adjustment circuit 310, the correction voltage generation unit 311, and the switches 312 and 313 form a correction current supply unit 314. The correction current supply unit 314 supplies a first correction current Ia and a second correction current Ib (described below) to the semiconductor laser 201.

The driving current supply unit 315 is described below.

As described above with reference to FIG. 2, the laser beam emitted from the semiconductor laser 201 is split by the beam splitter 204 and the resultant first laser beam is incident on the photodiode 205. The photodiode 205 generates a detection current Ip of a value corresponding to the light amount of the received first laser beam.

The photodiode 205 is connected to the I/V conversion circuit 301, and the detection current Ip (amount of received light) is input to the I/V conversion circuit 301. The I/V conversion circuit 301 converts the detection current Ip into a detection voltage Vp. The S/H circuit 302 samples and holds Vp in accordance with the sample and hold signal (S/H signal) transmitted from the CPU 211, and outputs the resultant sample and hold voltage $V_{S/H}$ to an input terminal 303*a* of the APC circuit 303.

The CPU 211 inputs a reference voltage Vref of a value corresponding to the target light amount of the laser beam to an input terminal 303*b* of the APC circuit 303. The APC circuit 303 compares the sample and hold voltage $V_{S/H}$ with the reference voltage Vref and sets the voltage of an output terminal 303*c* to a light amount control voltage Vapc based on the comparison result.

If the APC circuit 303 determines that $V_{S/H}$>Vref, the light amount of the laser beam incident on the photodiode 205 is larger than the target light amount. Thus, the APC circuit 303 reduces the value of the light amount control voltage Vapc that has been set to the output terminal 303*c* based on the potential difference between $V_{S/H}$ and Vref to bring the light amount of the laser beam incident on the photodiode 205 closer to the target light amount.

On the other hand, if the APC circuit 303 determines that $V_{S/H}$<Vref, the light amount of the laser beam incident on the photodiode 205 is smaller than the target light amount. Thus, the APC circuit 303 increases the voltage value of the light amount control voltage Vapc that has been set to the output terminal 303*c* based on the potential difference between $V_{S/H}$ and Vref to bring the light amount of the laser beam incident on the photodiode 205 closer to the target light amount.

If the APC circuit 303 determines that $V_{S/H}$=Vref, the light amount of the laser beam incident on the photodiode 205 is at the target light amount. Thus, the APC circuit 303 maintains the light amount control voltage Vapc that has been set to the output terminal 303*c*.

The APC circuit 303 is earthed (not illustrated) and the light amount control voltage Vapc is a potential difference from the ground voltage (0 V).

The output terminal 303*c* of the APC circuit 303 is connected to an input terminal 304*a* of the V/I conversion circuit 304. The CPU 211 inputs a gain adjustment signal (first gain adjustment signal) to the V/I conversion circuit 304. The V/I conversion circuit 304 corrects the voltage of the input terminal 304*a* based on the gain adjustment signal, and outputs the main current Im based on the corrected voltage from the output terminal 304*b*. Accordingly, the light amount control voltage Vapc set to the output terminal 303*c* of the APC circuit 303 is equal to the voltage of the input terminal 304*a* of the V/I conversion circuit 304. Thus, the V/I conversion circuit 304 outputs the main current Im based on the light amount control voltage Vapc set to the output terminal 303*c* of the APC circuit 303. The V/I conversion circuit 304 may convert the Vapc into the main current Im without performing the gain-based voltage adjustment.

The process of adjusting the light amount of the laser beam output from the semiconductor laser 201 to the target light amount by adjusting the value of the main current Im as described above is referred to as auto power control (APC).

The AND circuit 306 receives the light emission enable signal output from the CPU 211 and an image signal (video signal) output from the image processing unit 213. The CPU 211 outputs the light emission enable signal to the AND circuit 306 in response to the input of the image data to the image forming apparatus 100. The light emission enable signal and the image signal input to the AND circuit 306 are each a binary signal, and are each a high active signal in the present exemplary embodiment.

Based on the light emission enable signal and the image signal, the AND circuit 306 outputs a switch control signal Ssw for ON/OFF control on a switch. The AND circuit 306 outputs a high level switch control signal Ssw if the light emission enable signal and the image signal are both high level signals, and outputs a low level switch control signal Ssw if at least one of the light emission enable signal and the image signal is a low level signal The V/I conversion circuit 304 outputs the main current Im to an input terminal 305*a* of the switch 305. The switch 305 is controlled by the switch control signal Ssw from the AND circuit 306. The switch 305 is turned ON when the high level switch control signal Ssw is output from the AND circuit 306, and thus the main circuit Im flows from the input terminal 305*a* to the output terminal 305*b*. The switch 305 is turned OFF when the low level switch control signal Ssw is output from the AND circuit 306, and thus the input terminal 305*a* and the output terminal 305*b* are disconnected, and the main current Im does not flow from the input terminal 305*a* to the output terminal 305*b*. As described above, the image forming apparatus 100 according to the present exemplary embodiment performs the ON/OFF control on the switch 305 with the AND circuit 306, and thus supplies the main current Im to the semiconductor laser 201 based on the image signal. The CPU 211, the image processing unit 213, and the AND circuit 306 form a switch control unit that generates the switch control signal Ssw.

Figure 8:
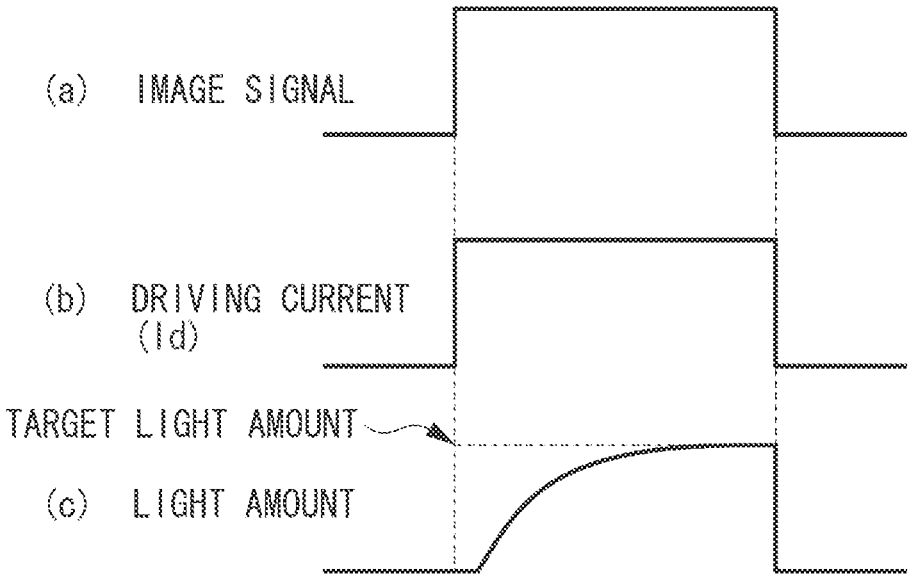
FIG. 8 is a diagram illustrating a conventional method for correcting the light emission delay characteristics of a semiconductor laser.
Figure 9:
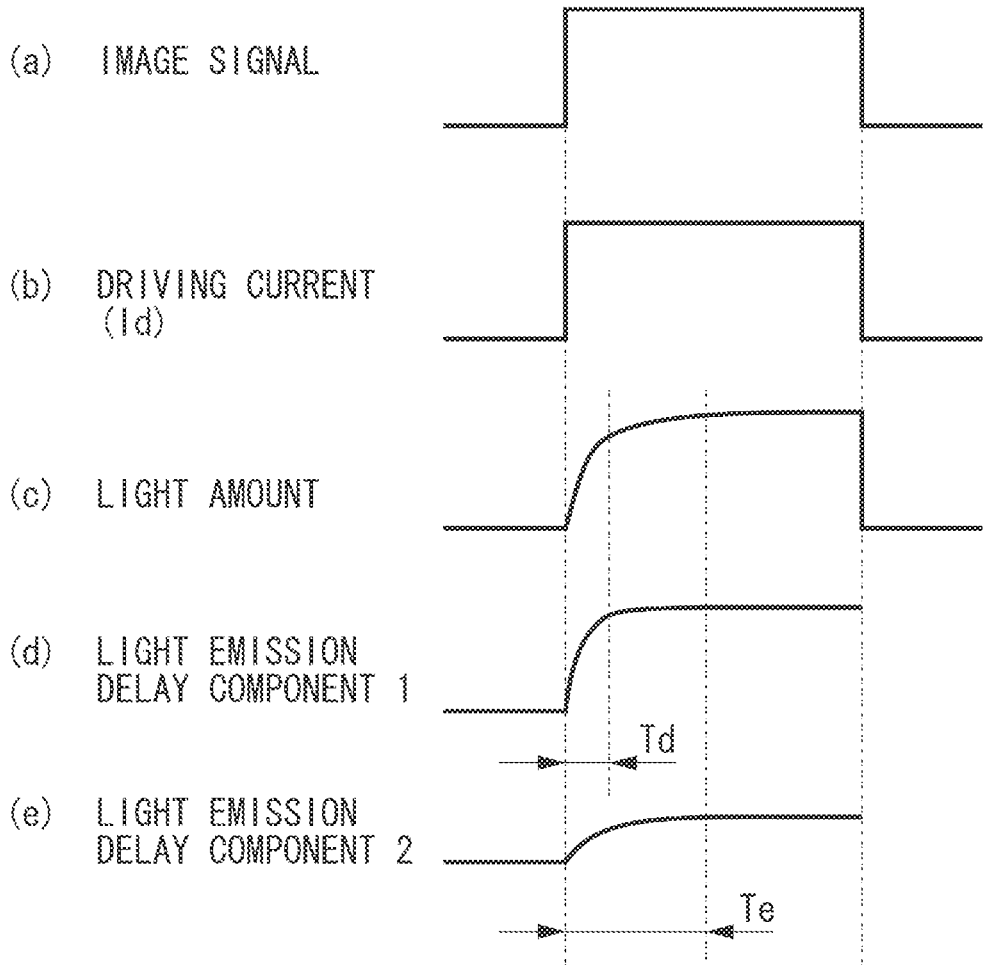
FIG. 9 is a diagram illustrating a problem in the conventional method for correcting the light emission delay characteristics of the semiconductor laser.

Now, the rising characteristic of the semiconductor laser will be described. As described above with reference to FIG. 8, the semiconductor laser has the light emission delay characteristics. Particularly, the VCSEL has a larger floating capacity than the edge emitting semiconductor laser that has been used for conventional electrophotographic image forming apparatuses, and thus the rising of the light amount immediately after the driving current supply start delays. Thus, the output of an image with a low density due to the light emission delay has been prevented by supplying a correction current that attenuates over time (at a predetermined time constant) in synchronization with the supply start of the driving current.

However, the conventional method for controlling a semiconductor laser cannot sufficiently prevent the low density of the output image due to the light emission delay for the semiconductor laser having light emission characteristics including a plurality of light emission delay components.

To correct such a light emission delay including a plurality of light emission delay components, the laser driver 212 according to the present exemplary embodiment includes the correction current supply unit 314 as illustrated in FIG. 3. The correction current supply unit 314 includes the voltage adjustment circuit 307 described above, the correction current generation unit 308, the switch 309, the current adjustment circuit 310, the correction current generation unit 311, and the switches 312 and 313. In the image forming apparatus 100 according to the present exemplary embodiment, the current adjustment circuit 307 and the correction current generation unit 308 form a first correction current generation unit, and the current adjustment circuit 310 and the correction current generation unit 311 form a second correction current generation unit. The present exemplary embodiment is described with an image forming apparatus in which the light emission delay component is classified into two delay components, and thus the two correction current generation units are provided to process the two delay components. However, an exemplary embodiment is not limited thereto, and an image forming apparatus that includes a semiconductor laser in which the light emission delay component is classified into three or more delay components may include a plurality of correction current generation units in number that is the same as the number of the delay components.

The switch 313 has an input terminal 313*a* connected to the output terminal 303*c* of the APC circuit 303, and an output terminal 313*b* connected to the input terminal 307*a* of the voltage adjustment circuit 307 and the input terminal 310*a* of the voltage adjustment circuit 310.

The switch 313 is controlled by the switch control signal Ssw. The switch 313 connects the input terminal 313*a* (first terminal) of which the voltage is set to the light amount control voltage Vapc and the output terminal 313*c* (third terminal) when the switch signal Ssw is at a low level, and connects the earthed input terminal (second terminal) and the output terminal 313*c* when the switch signal Ssw is at a high level. In other words, the voltage of the output terminal 313*c* is at the light amount control voltage Vapc when the switch control signal Ssw is at the low level, and is at the ground voltage (0 V) when the switch control signal Ssw is at the high level.

While the switch 313 is connecting the input terminal 313*a* and the output terminal 313*c*, the capacitors 401 and 411 are charged. While the switch 313 is connecting the input terminal 313*b* and the output terminal 313*c*, the capacitors 401 and 411 are discharged. The charging and the discharging of the capacitors 401 and 411 are not simultaneously performed because the switch 313 is controlled so that the input terminal 313*a* and the output terminal 313*c* are connected or so that the input terminal 313*b* and the output terminal 313*c* are connected.

The voltage adjustment circuit 307 receives a gain adjustment signal (second gain adjustment signal) from the CPU 211. The voltage adjustment circuit 307 sets the voltage of the output terminal 307*b* to the voltage Va obtained by adjusting the voltage set to the input terminal 307*a* with a gain based on the gain adjustment signal. Thus, while the switch 313 is connecting the input terminal 313*a* and the output terminal 313*c*, the voltage of the input terminal is at the light amount control voltage Vapc, and thus the voltage of the output terminal 307*b* is set to the voltage Va obtained through the voltage adjustment on the light amount control voltage Vapc with the gain based on the gain adjustment signal. On the other hand, while the switch 313 is connecting the input terminal 313*b* and the output terminal 313*c*, the voltage of the input terminal 307*a* is 0 V, and thus the voltage of the output terminal 307*b* is 0 V. With this configuration, the peak value of the correction current Ia is adjusted to a value corresponding to Vapc and the detection results of the potential sensor 214 and the optical sensor 117, or the Vapc and either one of the detection results of the potential sensor 214 and the optical sensor 117. The gain may be of a predetermined value, or may be set based on the rate of the value of the correction current Ia with respect to the value of the main voltage Im. The voltage adjustment circuit 307 may not perform the gain-based voltage adjustment, and may set the voltage of the output terminal 307*b* to the value set to the input terminal 307*a*.

Similarly, the voltage adjustment circuit 310 receives a gain adjustment signal (third gain adjustment signal) from the CPU 211. The voltage adjustment circuit 310 sets the voltage of the output terminal 310*b* to the voltage Vb obtained by adjusting the voltage set to the input terminal 310*a* with a gain based on the gain adjustment signal. Thus, while the switch 313 is connecting the input terminal 313*a* and the output terminal 313*c*, the voltage of the input terminal 310*a* is at the light amount control voltage Vapc, and the voltage of the output terminal 310*b* is set to the voltage Vb obtained by adjusting the light amount control voltage Vapc with the gain based on the gain adjustment signal. On the other hand, while the switch 313 is connecting the input terminal 313*b* and the output terminal 313*c*, the voltage of the input terminal 310*a* is 0 V, and thus the voltage of the output terminal 310*b* is 0 V. With this configuration, the peak value of the correction current Ib is adjusted to a value corresponding to the Vapc and the detection results of the potential sensor 214 and the optical sensor 117, or the Vapc and either one of the detection results of the potential sensor 214 and the optical sensor 117. The gain may be of a predetermined value, or may be set based on the rate of the correction current Ib with respect to the main voltage Im. The voltage adjustment circuit 310 may not perform the gain-based voltage adjustment, and may set the voltage of the output terminal 310*b* to the value set to the input terminal 310*a*.

The correction current generation unit 308 has an input terminal 308*a* connected to the output terminal 307*b* of the voltage adjustment circuit 307. The correction current generation unit 311 has an input terminal 311*a* connected to the output terminal 310*b* of the voltage adjustment circuit 310.

Figure 4A:
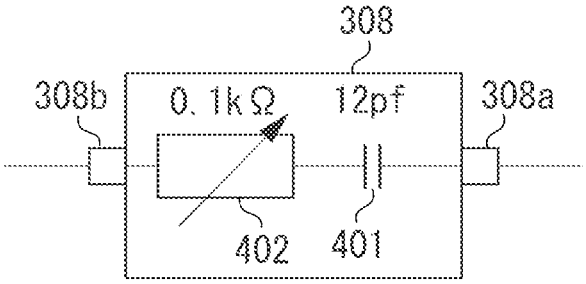
FIGS. 4A and 4B each illustrate an internal configuration of a correction current generation unit.
Figure 4B:
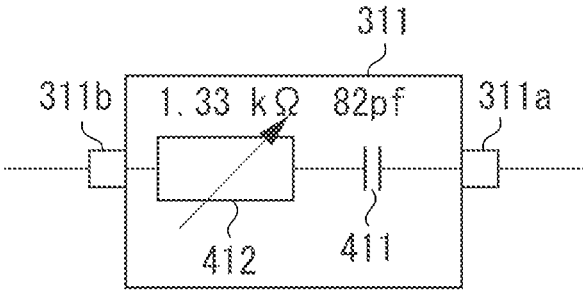

FIGS. 4A and 4B illustrate circuit configurations of the correction current generation units 308 and 311, respectively. The correction current generation unit 308 includes the capacitor 401 (first capacitor) and a variable resistor 402 (first resistor). The correction current generation unit 311 includes the capacitor 411 (second capacitor) and a variable resistor 412 (second resistor).

As illustrated in FIG. 4A, the capacitor 401 and the variable resistor 402 are connected in series with the input terminal 308*a* and the output terminal 308*b*. As illustrated in FIG. 4B, the capacitor 411 and the variable resistor 412 are connected in series with the input terminal 311*a* and the output terminal 311*b*.

Capacitances of the capacitors 401 and 411 are set based on the light emission delay characteristics of the semiconductor laser 201. In the image forming apparatus 100 according to the present exemplary embodiment, for example, the capacitor 401 having a capacitance of 12 pF (first capacitance) is used for the correction voltage generation unit 308, and the capacitor 411 having a larger capacitance than the capacitor 401 is used for the correction voltage generation unit 311. In the present exemplary embodiment, the capacitance of the capacitor 411 is 82 pF (second capacitance).

Like the capacitances of the capacitors 401 and 411, the resistances of the variable resistors 402 and 412 are set based on the light emission delay time that is one of the light emission delay characteristics of the semiconductor laser 201. In the image forming apparatus 100 according to the present exemplary embodiment, the resistance of the variable resistor 402 used in the correction current generation unit 308 is set to, for example, 0.1 KΩ (first resistance), and the resistance of the variable resistor 412 used in the correction current generation unit 311 is set to, for example, 1.33 KΩ (second resistance) which is larger than 0.1 KΩ. The resistances of the variable resistors 402 and 412 are set at the time of adjustment in a factory based on the light emission delay time of the semiconductor laser 201 measured in the factory.

The switch 309 has an input terminal 309*a* connected to the output terminal 308*b* of the correction current generation unit 308. The switch 309 is ON/OFF controlled by the switch control signal Ssw. Like the switch 305, the switch 309 turns ON when the switch control signal Ssw is at a high level, and is turned OFF when the switch control signal Ssw is at a low level. When the switch 309 is turned ON, the correction current Ia flows from the input terminal 309*a* to the output terminal 309*b*. When the switch 309 is turned OFF, the correction current Ia does not flow from the input terminal 309*a* to the output terminal 309*b*.

When the switch 309 turns ON, the correction current generation unit 308 outputs from the output terminal 308*b* the correction current Ia that attenuates over time from the peak value to 0 A. The time constant of the correction current Ia output from the output terminal 308*b* is determined by the capacitance of the capacitor 401 and the resistance of the resistor 402.

The switch 312 has an input terminal 312*a* connected to the output terminal 311*b* of the correction current generation unit 311. The switch 312 is ON/OFF controlled by the switch control signal Ssw. Like the switch 309, the switch 312 is turned ON when the switch control signal Ssw is at a high level, and is turned OFF when the switch control signal Ssw is at a low level. When the switch 312 is turned ON, the correction current Ib flows from the input terminal 312*a* to the output terminal 312*b*. When the switch 312 is turned OFF, the correction current Ib does not flow from the input terminal 312*a* to the output terminal 312*b*.

When the switch 312 is turned ON, the correction current generation unit 311 outputs from the output terminal 311*b* the correction current Ib that attenuates over time from the peak value to 0 A. The time constant of the correction current Ib output from the output terminal 311*b* is determined by the capacitance of the capacitor 411 and the resistance of the resistor 412.

The switches 309 and 312 respectively have output terminals 309*b* and 312*b* connected to the semiconductor laser 201. The driving current Id as the sum of the main current Im, the correction current Ia, and the correction current Ib is supplied to the semiconductor laser 201.

The correction of the light emission delay characteristics is described in detail with reference to a timing chart in FIG. 5 in which (a) to (f) respectively illustrate the image signal input to the AND circuit 306; the main current Im supplied to the semiconductor laser 201 from the V/I conversion circuit 304; the correction current Ia supplied to the semiconductor laser 201 from the correction current generation unit 308; the correction current Ib supplied to the semiconductor laser 201 from the correction current generation unit 311; the driving current Id as the sum of the main current Im, the correction current Ia, and the correction current Ib; a light amount wave form of the laser light output from the semiconductor laser 201 to which the driving current Id is supplied.

First, the correction current Ia illustrated in (c) is first described. In the capacitor 401, electric charge Qa is accumulated. The amount of electric charge accumulated in the capacitor 401 is determined by the voltage applied to the capacitor 401 and the capacitance of the capacitor 401.

In FIG. 3, the capacitor 401 is charged while the switch 313 is connecting the input terminal 313*a* and the output terminal 313*c*. When the low level switch control signal Ssw is transmitted from the AND circuit 306, the switch 313 connects the input terminal 313*a* and the output terminal 313*c*. Thus, the voltage of the output terminal 307*b* of the voltage adjustment circuit 307 is set to a value obtained through the voltage adjustment on the light amount control voltage Vapc, whereby the electric charge is accumulated in the capacitor 401. In FIG. 3, while the switch 313 is connecting the input terminal 313*a* and the output terminal 313*c*, the switch 309 is in the OFF state, whereby the electric charge accumulated in the capacitor 401 is not discharged.

The electric charge Qa accumulated in the capacitor 401 is discharged from the capacitor 401 when the switch control signal Ssw from the AND circuit 306 rises to a high level and the switch 309 is turned ON. The electric charge Qa is discharged from the capacitor 401 as the correction current Ia illustrated in (c) in FIG. 5. While the switch 309 is in the ON state, the switch 313 is connecting the input terminal 313*b* and the output terminal 313*c*. In this state, the voltage of the output terminal 307*b* of the voltage adjustment circuit 307 is 0 V, and thus no electric charge is newly accumulated in the capacitor 401.

Figure 5:
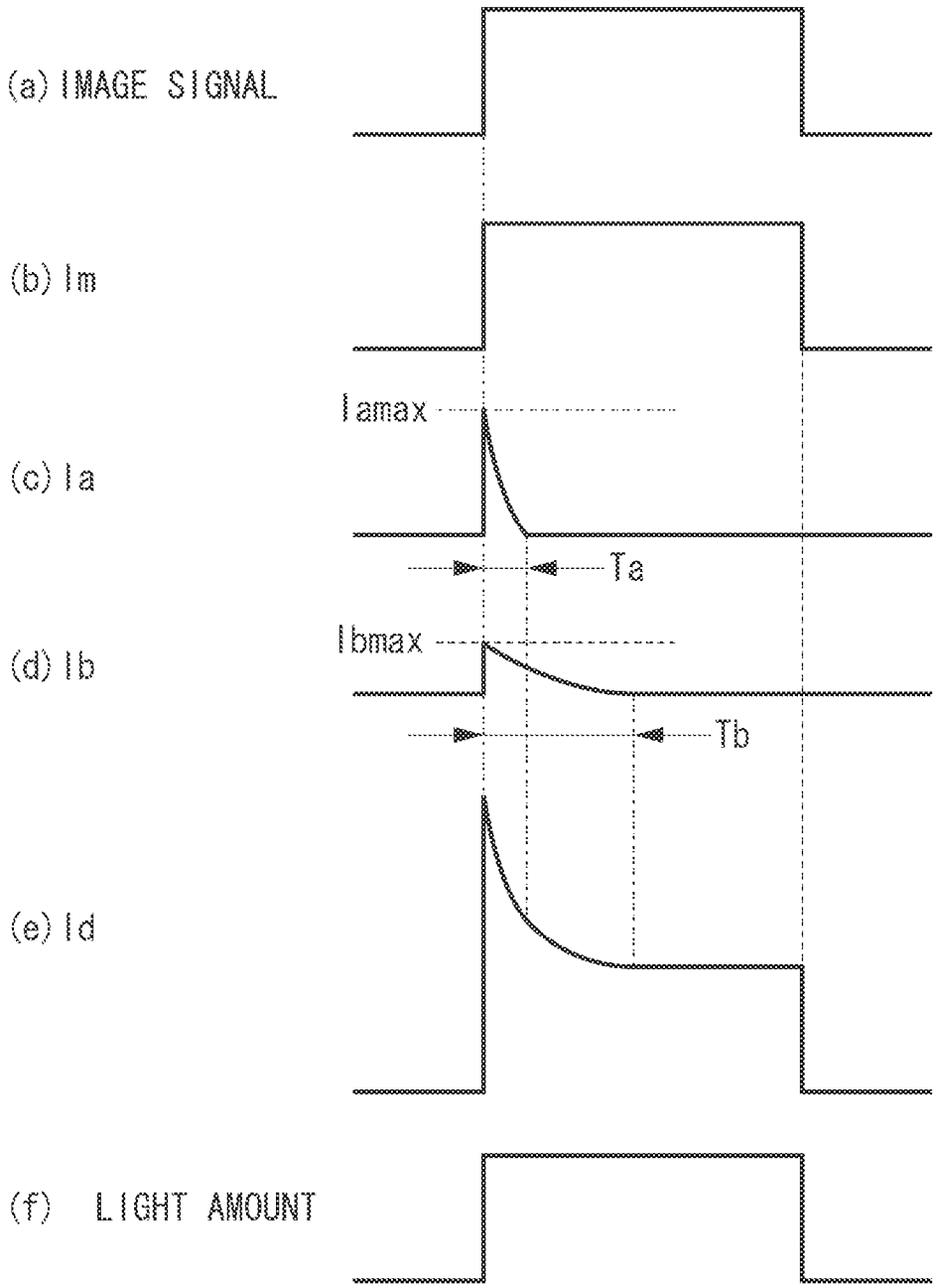
FIG. 5 illustrates light emission delay characteristics of the semiconductor laser and supply timings of main and correction currents.

As illustrated in (c) in FIG. 5, the correction current Ia is at the maximum value (peak value Iamax) right after the switch 309 is turned ON, and attenuates over time. An integrated value of Ia illustrated in (c) in FIG. 5 is determined by the light amount control voltage Vapc and the capacitance of the capacitor 401. Thus, the amount of the electric charge Qa accumulated in the capacitor 401 is determined by the voltage applied to the capacitor 401 and the capacitance of the capacitor 401. Since Qa=Vapc×C1 (C1=12 pF) holds true, when the value of the light amount control voltage Vapc increases, the amount of the electric charge Qa increases, and the integrated value of the correction current Ia increases.

Next, the correction current Ib illustrated in (b) in FIG. 5 is described. The electric charge Qb is accumulated in the capacitor 411. The amount of electric charge accumulated in the capacitor 411 is determined by the voltage applied to the capacitor 411 and the capacitance of the capacitor 411.

In FIG. 3, like the capacitor 401, the capacitor 411 is charged while the switch 313 is connecting the input terminal 313*a* and the output terminal 313*c*. While the switch 313 is connecting the input terminal 313*a* and the output terminal 313*c*, the voltage set to the output terminal 310*b* of the voltage adjustment circuit 310 is of a value obtained by adjusting the light amount control voltage Vapc. Thus, the electric charge is charged in the capacitor 411. In FIG. 3, while the switch 313 is connecting the input terminal 313*a* and the output terminal 313*c*, the switch 312 is in the OFF state, and thus the electric charges accumulated in the capacitor 411 are not discharged.

The electric charge Qb accumulated in the capacitor 411 is discharged from the capacitor 411 when the switch control signal Ssw rises to a high level and the switch 312 is turned ON. The electric charge Qb is discharged from the capacitor 411 as the correction current Ib illustrated in (d) in FIG. 5. While the switch 312 is in the ON state, the switch 313 is connecting the input terminal 313*b* and the output terminal 313*c*. In this state, the voltage of the output terminal 310*b* of the voltage adjustment circuit 310 is 0 V, and thus no electric charge is newly accumulated in the capacitor 411.

As illustrated in (d) of FIG. 5, the correction current Ib is at the maximum value (peak value Ibmax) right after the switch 312 is turned ON, and attenuates over time (at a predetermined time constant). The integrated value of Ib illustrated in (d) of FIG. 5 is determined by the light amount control voltage Vapc and the capacitance of the capacitor 411. Thus, the amount of the electric charge Qb accumulated in the capacitor 411 is determined by the voltage applied to the capacitor 411 and the capacitance of the capacitor 411. Since Qb=Vapc×C2 (C2=82 pF) holds true, when the value of the light amount control voltage Vapc increases, the amount of the electric charge Qb increases, and thus the integrated value of the correction current Ib increases.

In the image forming apparatus according to the present exemplary embodiment, the correction current generation unit 308 and the correction current generation unit 311 are configured in such a manner that the maximum value Iamax of the correction current Ia is larger than the maximum value Ibmax of the correction current Ib, and that the discharge speed of the capacitor 401 is faster than the discharge speed of the capacitor 411.

The value of Iamax and the discharge speed of the capacitor 401 are determined by the capacitance of the capacitor 401 and the resistance of the variable resistor 402. Thus, the amount of the electric charge Qa accumulated in the capacitor 401 is determined by the capacitance C1, and when a larger voltage is applied to the capacitor 401, a larger amount of the electric charge Qa is accumulated in the capacitor 401. A longer time is required to discharge the larger amount of electric charge Qa. The current flows easier right after the switch 309 is turned ON in a case where the resistance of the variable resistor 402 is set to R1 than in a case where the resistance is set to R2 (<R1). Thus, the maximum value of the correction current is larger in the case where the variable resistor 402 is set to R1 than in the case where the resistance is set to R2.

Since the current flows easier in the case where the resistance of the variable resistor 402 is set to R1 than in the case where the resistance is set to R2, as illustrated in (c) and (d) in FIG. 5, the discharge time (Ta) in the case where the resistance of the variable resistor 402 is set to R1 is shorter than the discharge time (Tb) in the case where the resistance is set to R2. Thus, the discharge speed is faster in the case where the resistance of the variable resistor 402 is set to R1 than in the case where the resistance is set to R2

Accordingly, the resistance (0.1 KΩ) of the variable resistor 402 is set to be smaller than the resistance (1.33 KΩ) of the variable resistor 412, whereby the maximum value Iamax of the correction current Ia is set to be larger than the maximum value Ibmax of the correction current Ib. Furthermore, the discharge speed of the capacitor 401 is set to be faster than the discharge speed of the capacitor 411. By thus configuring the correction current generation units 308 and 311, the correction current Ia and the correction current Ib can be generated that respectively attenuate from Iamax and Ibmax over time in different speeds to 0 V as illustrated in FIG. 5.

As illustrated in (e) of FIG. 5, when starting the supplying of the driving current Id to the semiconductor laser 201, the laser driver 212 illustrated in FIG. 3 receives a current as a sum of the main current Im corresponding to the target light amount of the laser beam, the correction current Ia, and the correction current Ib. Thus, at the supply start timing of the driving current Id, the current larger than the current (=main current Im) corresponding to the target light amount of the laser beam is supplied to the semiconductor laser 201. After the supply start of the driving current Id, the correction current Ia and the correction current Ib attenuate over time toward 0 A. Thus, the driving current Id attenuates from the current larger than the current (=main current Im) corresponding to the target light amount of the laser beam to the current (=main current Im) corresponding to the target light amount of the laser beam.

By thus supplying the correction current Ia and the correction current Ib in synchronization with the supply start of the main current Im (driving voltage), the light amount can be prevented from being insufficient at the time of the rising of the light amount as illustrated in (f) of FIG. 5. By supplying a plurality of currents Ia and Ib to the semiconductor laser 201 in synchronization with the supply start of the main current Im, accurate light amount correction can be performed even when the semiconductor laser having light emission characteristics in which the light emission delay component at the supply start timing of the main current Im is classified into a plurality of light emission delay components. Thus, the insufficient light amount at the time of light amount rising is prevented and thus an output of an image with a low density can be prevented.

Due to the individual difference, the light emission delay component slightly differs among the semiconductor lasers. Thus, the resistances of the variable resistors 402 and 411 set at different values for different semiconductor lasers installed in image forming apparatuses, at the time of adjustment in the factory. Although not illustrated in the figures, a variable capacitor that generates a correction current in accordance with the individual difference of the semiconductor laser may be used as the capacitor.

In the present exemplary embodiment, the image forming apparatus including two correction current generation units is described. Alternatively, three or more correction current generation units may be provided for the semiconductor laser in which the light emission delay component of the light emission characteristics are classified into three or more types. In the present exemplary embodiment, the description is given of a device with a single emission point as an example. For a semiconductor laser with a plurality of luminous points, the correction current generation unit is provided for each luminous point.

Figure 6:
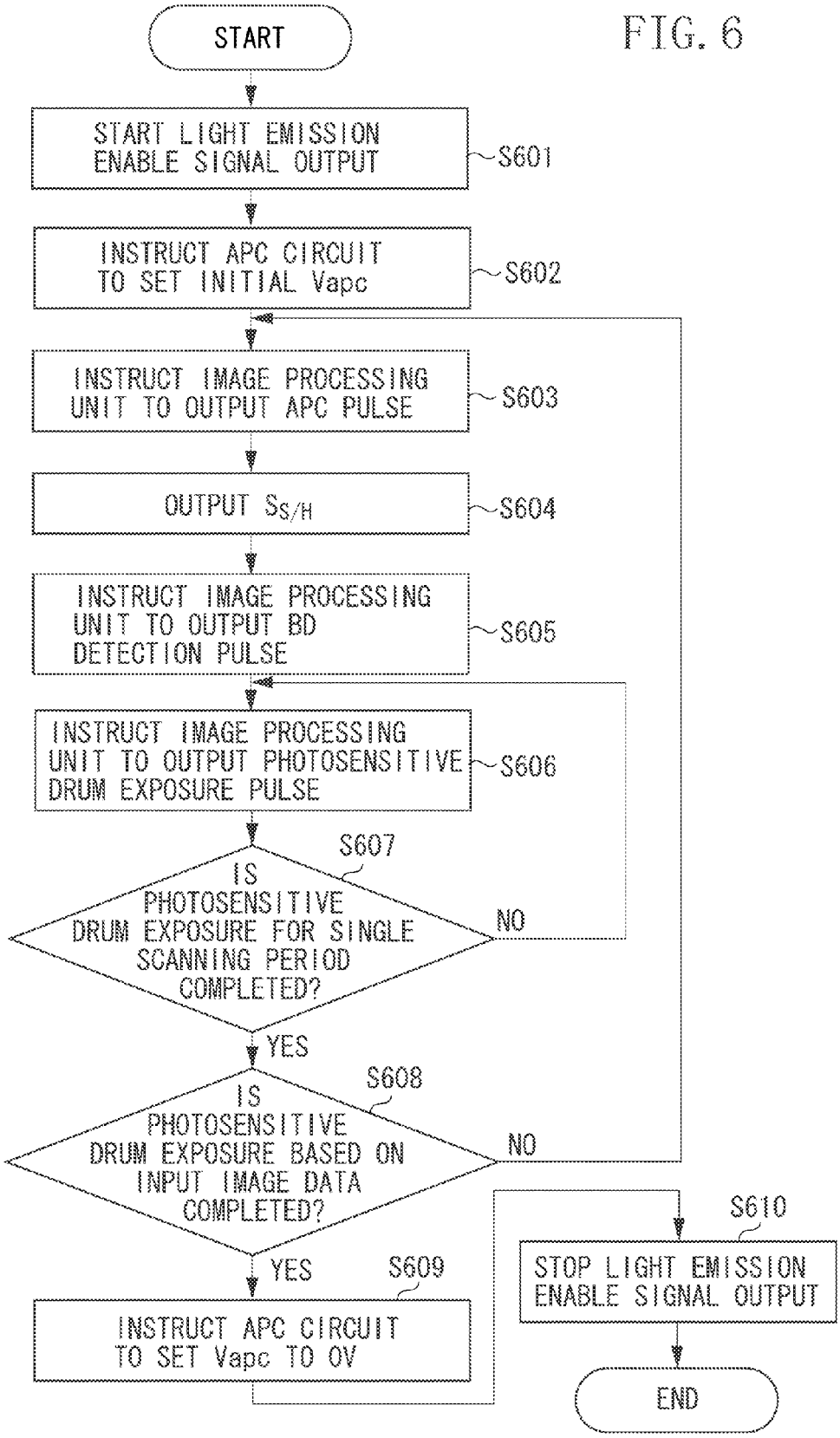
FIG. 6 illustrates a control flow executed by a central processing unit (CPU).
Figure 7:
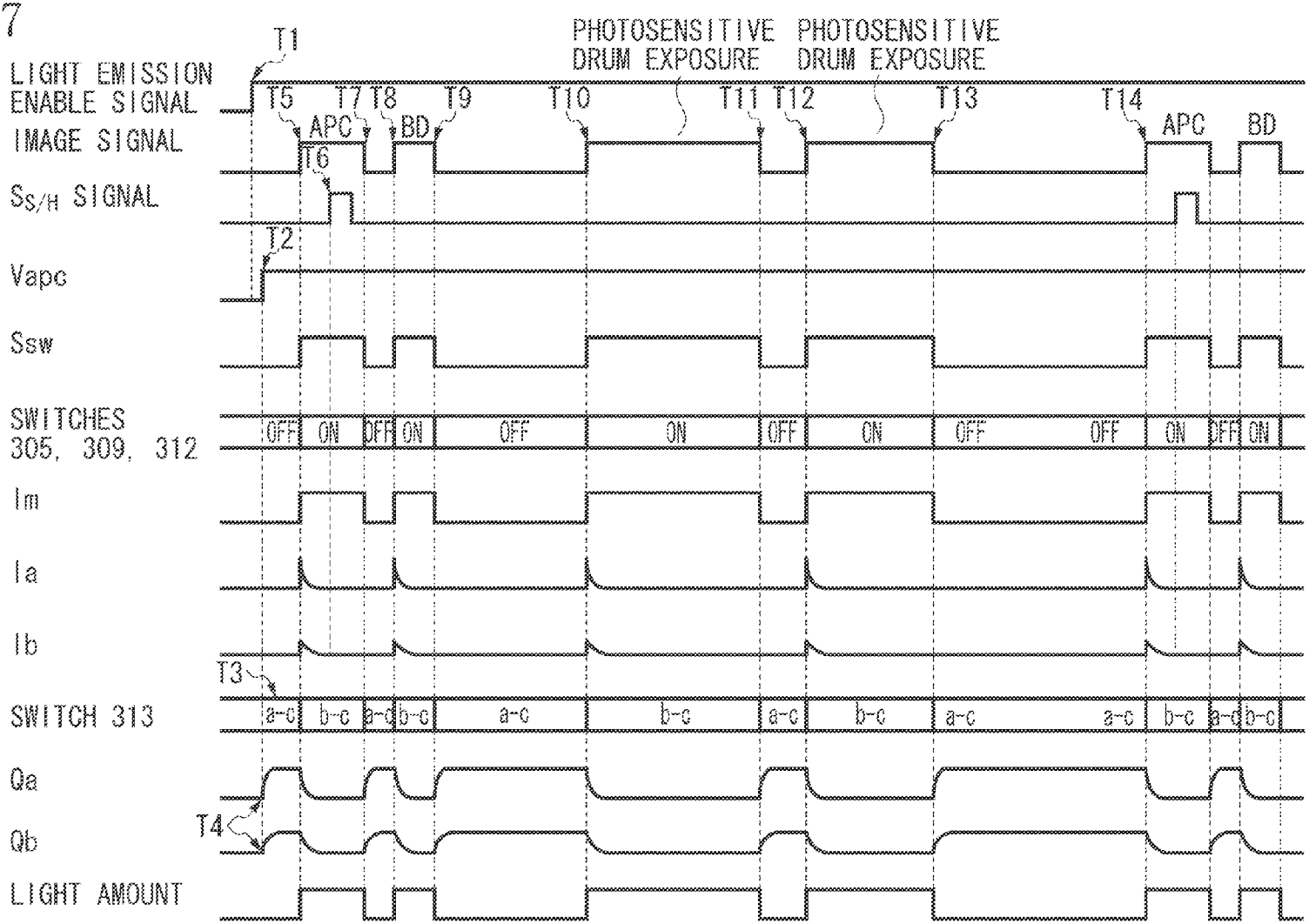
FIG. 7 is a timing chart illustrating operations of the image forming apparatus according to an exemplary embodiment.

FIG. 6 is a flow chart of a control flow executed by the CPU 211 provided in the image forming apparatus 100 according to the present exemplary embodiment. FIG. 7 is a timing chart illustrating operations of the image forming apparatus 100 performed when the CPU 211 executes the control flow illustrated in FIG. 6. An image forming operation of the image forming apparatus 100 is described with reference to FIGS. 6 and 7.

In FIG. 7, (a) to (m) respectively illustrate the light emission enable signal; the image signal; the $S_{S/H}$ signal (sample and hold signal); the Vapc (light amount control voltage); the switch control signal Ssw; the state of the switches 305, 309, and 312; the main current Im; the correction current Ia; the correction current Ib; the state of the switch 313; an electric charge accumulation state of the capacitor 401; an electric charge accumulation state of the capacitor 411; and a light emission state (light amount waveform) of the semiconductor laser 201. In (j) the state of the switch 313, "a-c" represents a state where the switch 313 is connecting the input terminal 313*a* and the output terminal 313*c* and "a-b" represents a state where the switch 313 is connecting the input terminal 313*b* and the output terminal 313*c*.

As illustrated in FIG. 6, the CPU 211 outputs the light emission enable signal to the AND circuit 306 in response to an input of an image forming job to the image forming apparatus from an external information terminal such as a reading apparatus and a CPU in step S601 and at a timing T1 in FIG. 7. The CPU 211 keeps outputting the light emission enable signal until the image forming based on the image forming job is completed.

After outputting the light emission enable signal, the CPU 211 instructs the APC circuit 303 to set the voltage of the output terminal 303*c* to an initial Vapc in step S602. As illustrated in FIG. 7, the APC circuit 303 sets the voltage of the output terminal 303*c* to the initial Vapc in response to the instruction from the CPU 211 at a timing T2. For the first APC operation after the image forming job is input, the CPU 211 causes the semiconductor laser 201 to output a laser beam. The initial Vapc is a voltage determined at the designing stage in such a manner that an excessively high main voltage Im is not supplied to the semiconductor laser 201 in the first APC operation. When the voltage of the output terminal 303*c* of the APC circuit 303 is set to the initial Vapc, since the switch 313 is connecting the input terminal 313*a* and the output terminal 313*c* at a timing T3, the accumulation of electric charge into the capacitors 401 and 411 starts at a timing T4.

As illustrated in FIG. 6, after step S602, in step S603, the CPU 211 instructs the image processing unit 213 to output APC pulse for the APC operation to be performed. As illustrated in FIG. 7, the image processing unit 213 outputs the APC pulse as a high level image signal in response to the APC pulse output instruction from the CPU 211 at a timing T5. In response to the output of the APC pulse, the AND circuit 306 outputs the high level switch control signal Ssw that turns ON the switches 305, 309, and 312. Since the switch 305 is turned ON, the V/I conversion circuit 304 supplies the main current Im of a value based on the light amount control voltage Vapc to the semiconductor laser 201. Since the switches 309 and 312 are turned ON, the correction current Ia and the correction current Ib are supplied to the semiconductor laser 201. In other words, the correction current Ia and the correction current Ib are supplied to the semiconductor laser 201 in synchronization with the supply start of the main current Im. At the timing T5 in FIG. 7, the capacitors 401 and 411 start discharging as illustrated in (k) and (l) in FIG. 7.

After the step S603, in step S604, the CPU 211 outputs the sample and hold signal $S_{S/H}$ to the sample and hold circuit 302 as indicated at a timing T6 in FIG. 7. In response to the sample and hold signal $S_{S/H}$ from the CPU 211, the sample and hold circuit 302 samples and holds the output voltage Vp from the I/V conversion circuit 301 and outputs the resultant sample and hold voltage $V_{S/H}$ to the APC circuit 303. The APC circuit 303 sets the voltage of the output terminal 303*b* to the light amount control voltage Vapc based on the sample and hold voltage $V_{S/H}$ and the reference voltage Vref as described above. For simplifying the description, the light amount control voltage Vapc is not changed from the initial Vapc in (c) of FIG. 7. However, the light amount control voltage Vapc actually changes from the initial Vapc in accordance with the value of the sample and hold voltage $V_{S/H}$.

As illustrated in FIG. 7, the APC pulse supplying time is set in such a manner that the pulse falls at a timing T7 when a predetermined time elapses after the APC pulse output start point indicated by the timing T5. When the APC pulse falls, (i.e., the image signal falls to a low level), the AND circuit 306 outputs the low level switch control signal Ssw that turns OFF the switches 305, 309, and 312, and the switch 313 connects the input terminal 313*a* and the output terminal 313*c*. Since the switch 305 is turned OFF, the main current Im is not supplied to the semiconductor laser 201. Since the switches 309 and 312 are turned OFF, the correction current Ia and the correction current Ib are not supplied to the semiconductor laser 201. Since the switch 313 is connecting the input terminal 313*a* and the output terminal 313*c*, the accumulations of the electric charge in the capacitor 401 and 411 starts as illustrated in (k) and (l) in FIG. 7.

As illustrated in FIG. 6, after step S604, in step S605, the CPU 211 instructs the image processing unit 213 to output a BD detection pulse so that a BD signal is generated. As illustrated in FIG. 7, at a timing T8, the image processing unit 213 outputs the BD detection pulse that is a high level image signal in response to the BD detection pulse output instruction from the CPU 211. The output of the BD detection pulse triggers the output of the high level switch control signal Ssw from the AND circuit 303, whereby the switches 305, 309, and 312 are turned ON. Since the switch 305 is turned ON, the main current Im of a value based on the light amount control voltage Vapc is supplied to the semiconductor laser 201 from the V/I conversion circuit 304. Since the switches 309 and 312 are turned ON, the electric charge accumulated in the capacitors 401 and 411 are supplied to the semiconductor laser 201 as the correction current Ia and the correction current Ib. Upon receiving, as the driving current Id, the main current Im, the correction current Ia, and the correction current Ib, the semiconductor laser 201 outputs the laser beam. At the timing T8 in FIG. 7, the capacitors 401 and 411 start discharging as illustrated in (k) and (l) in FIG. 7. The laser beam output from the semiconductor laser 201 is incident on the BD 210. The BD 210 generates the synchronization signal Ssyn upon receiving the laser beam.

As illustrated in FIG. 7, the BD pulse supplying time is set in such a manner that the pulse falls at a timing T9 when a predetermined time elapses after the BD detection pulse output start point indicated by the timing T8. When the BD pulse falls, (i.e., the image signal falls to a low level), the AND circuit 306 outputs the low level switch control signal Ssw that turns OFF the switches 305, 309, and 312, and the switch 313 connects the input terminal 313*a* and the output terminal 313*c*. Since the switch 305 is turned OFF, the main current Im is not supplied to the semiconductor laser 201. Since the switches 309 and 312 are turned OFF, the correction current Ia and the correction current Ib are not supplied to the semiconductor laser 201. Since the switch 313 connects the input terminal 313*a* and the output terminal 313*c*, again, the accumulation of the electric charge in the capacitor 401 and 411 starts as illustrated in (k) and (l) in FIG. 7.

As illustrated in FIG. 6, in step S606, the CPU 211 instructs the image processing unit 213 to output a photosensitive drum exposure pulse with the timing of the synchronization signal generated at step S605 as reference.

In response to the photosensitive drum exposure pulse output instruction from the CPU 211, the image processing unit 213 outputs the photosensitive drum exposure pulse that is a high level image signal. In the present exemplary embodiment, in FIG. 7, the photosensitive drum exposure pulse rises at the timing T10, falls at a timing T11, and again rises at a timing T12, and then falls at a timing T13.

When the photosensitive drum exposure pulse rise to a high level as indicated by the timings T10 and T12 in FIG. 7, the AND circuit 306 outputs a high level switch control signal Ssw and thus, the switches 305, 309, and 312 are turned ON. Since the switch 305 is turned ON, the V/I conversion circuit 304 supplies the main current Im of a value based on the light amount control voltage Vapc to the semiconductor laser 201. Since the switches 309 and 312 are turned ON, the electric charge accumulated in the capacitors 401 and 411 are supplied to the semiconductor laser 201 as the correction current Ia and the correction current Ib. Upon receiving, as the driving current Id, the main current Im, the correction currents Ia, and the correction current Ib, the semiconductor laser 201 emits the laser beam. The laser beam output from the semiconductor laser 201 is guided onto the photosensitive drum. The laser beam guided onto the photosensitive drum forms an electrostatic latent image on the photosensitive drum. The correction current Ia and the correction current Ib are supplied to the semiconductor laser 201 in synchronization with the supply start of the main current Im. Thus, as illustrated in (m) in FIG. 7, the light amount waveform rising delay is prevented for the semiconductor laser 201 having the light emission characteristics in which the light emission delay is classified into a plurality of light emission delay components. The capacitor 401 and 411 start discharging at the timings T10 and T12 in FIG. 7 as illustrated in (k) and (l) in FIG. 7.

When the photosensitive drum exposure pulse falls at the timings T11 and T13 in FIG. 7 (i.e., when the image signal falls to a low level), the AND circuit 306 outputs the low level switch control signal Ssw that turns OFF the switches 305, 309, and 312, and the switch 313 connects the input terminal 313*a* and the output terminal 313*c*. Since the switch 305 is turned OFF, the main current Im is not supplied to the semiconductor laser 201. Since the switches 309 and 312 are turned OFF, the correction current Ia and the correction current Ib are not supplied to the semiconductor laser 201. Since the switch 313 connects the input terminal 313*a* and the output terminal 313*c*, again, the accumulation of electric charge in the capacitor 401 and 411 starts as illustrated in (k) and (l) in FIG. 7.

After step S606, the CPU 211 determines whether the photosensitive drum exposure of a single scanning period is completed in step S607. When it is determined in step S607 that the photosensitive drum exposure of a single scanning period is not completed (NO in step S607), the CPU 211 returns the control to step S606. When it is determined in step S607 that the photosensitive drum exposure of a single scanning period is completed (YES in step S607), the CPU 211 determines whether the photosensitive drum exposure based on the input image data is completed in step S608. When it is determined in step S608 that the photosensitive drum exposure based on the input image data is not completed (NO in step S608), the CPU 211 returns the control to step S603. When it is determined in step S608 that the photosensitive drum exposure based on the input image data is completed (YES in step S608), the CPU 211 instructs the APC circuit to set Vapc to 0 V (step S609), and then stops outputting the light emission enable signal in step S610.

As described above, an image forming apparatus according to the present exemplary embodiment corrects the value of a driving current (main current) and the value of a correction current supplied in synchronization with the supply start of the driving current based on a reception result of a light receiving unit. Thus, the correction current can be set to a value according to the value of the driving current. The image forming apparatus according to the present exemplary embodiment includes a plurality of correction current generation units that each can generate a correction current. Thus, a light amount can be accurately corrected even when a semiconductor laser having a light emission characteristics in which a light emission delay component at the supply start timing of the driving current (main current) is classified into a plurality of light emission delay components. Accordingly, an insufficient light amount at the time of rising of the light amount is prevented, and thus output of an image with a low density can be prevented.

While exemplary embodiments have been provided, it is to be understood that these embodiments are not seen to be limiting. The scope of the following claims is to be accorded the broadest interpretation so as to encompass all such modifications and equivalent structures and functions.

This application claims the benefit of Japanese Patent Application No. 2012-237798, filed Oct. 29, 2012, and Japanese Patent Application No. 2013-184048, filed Sep. 5, 2013, which are hereby incorporated by reference herein in their entirety.

What is claimed is:

1. An image forming apparatus comprising:

a semiconductor laser configured to emit a laser beam by receiving a current, wherein a light amount of the laser beam corresponds to a value of the current;

a photosensitive member configured to be exposed to the laser beam emitted from the semiconductor laser so that an electrostatic latent image is formed thereon;

a light receiving unit configured to receive the laser beam emitted from the semiconductor laser;

a driving current supply unit configured to supply a driving current to the semiconductor laser based on an image signal and configured to control a value of the driving current based on a reception result of the light receiving unit; and a correction current supply unit including a first correction current generation unit configured to generate a first correction current that attenuates over time from a peak value thereof and a second correction current generation unit configured to generate a second correction current that attenuates over time from a peak value thereof and of which an attenuation speed is lower than that of the first correction current, configured to supply the first correction current and the second correction current to the semiconductor laser in synchronization with a supply start of the driving current to the semiconductor laser to superimpose the first correction current and the second correction current on the driving current, and configured to control the peak value of the first correction current and the peak value of the second correction current based on the reception result of the light receiving unit, wherein the peak value of the first correction current is larger than the peak value of the second correction current.

2. The image forming apparatus according to claim 1 further comprising a potential detection unit configured to detect a potential of the electrostatic latent image, wherein the driving current supply unit controls the value of the driving current based on the reception result of the light receiving unit and a detection result of the potential detection unit so that a light amount of the laser beam to which the photosensitive member is exposed is adjusted to a target light amount.

3. The image forming apparatus according to claim 2, wherein the driving current supply unit sets a driving voltage based on the reception result of the light receiving unit and corrects the driving voltage based on the detection result of the potential detection unit, and wherein the driving current supply unit supplies the driving current of a value based on the driving voltage corrected to the semiconductor laser.

4. The image forming apparatus according to claim 1 further comprising a density detection unit configured to detect a density of an image formed by the image forming apparatus, wherein the driving current supply unit controls the value of the driving current based on the reception result of the light receiving unit and a detection result of the density detection unit so that a light amount of the laser beam to which the photosensitive member is exposed is adjusted to a target light amount.

5. The image forming apparatus according to claim 4, wherein the driving current supply unit sets a driving voltage based on the reception result of the light receiving unit and corrects the driving voltage based on the detection result of the density detection unit, and wherein the driving current supply unit supplies the driving current of a value based on the driving voltage corrected to the semiconductor laser.

6. The image forming apparatus according to claim 1, wherein the semiconductor laser is a Vertical Cavity Surface Emitting LASER.

7. The image forming apparatus according to claim 1, wherein the semiconductor laser includes a plurality of light emitting points, and the correction current supply unit is provided for each of the plurality of light emitting points.

* * * * *